US006210497B1

(12) United States Patent
Saito et al.

(10) Patent No.: US 6,210,497 B1
(45) Date of Patent: Apr. 3, 2001

(54) SUPER HEAT-RESISTING MO-BASED ALLOY AND METHOD OF PRODUCING SAME

(75) Inventors: Junichi Saito; Yoshiaki Tachi; Shigeki Kano, all of Mito; Masahiko Morinaga; Yoshinori Murata, both of Nagoya; Satoshi Inoue, Mishima; Mitsuaki Furui, Nagoya, all of (JP)

(73) Assignees: Doryokuro Kakunenryo Kaihatsu Jigyodan, Tokyo; Toyohashi University of Technology, Aichi-ken, both of (JP)

( * ) Notice: Subject to any disclaimer, the term of this patent is extended or adjusted under 35 U.S.C. 154(b) by 0 days.

(21) Appl. No.: 09/241,316

(22) Filed: Feb. 1, 1999

Related U.S. Application Data

(63) Continuation of application No. 08/736,590, filed on Oct. 24, 1996, now abandoned.

(30) Foreign Application Priority Data

Oct. 24, 1995 (JP) ..... 7-275984

(51) Int. Cl.[7] ..... C22C 27/04
(52) U.S. Cl. ..... 148/423; 420/429
(58) Field of Search ..... 148/423; 420/429

(56) References Cited

U.S. PATENT DOCUMENTS 5,437,744 8/1995 Carlen .
5,595,616 1/1997 Berczik .

FOREIGN PATENT DOCUMENTS 0 608 817 8/1994 (EP) .
816 135 7/1959 (GB) .
1286096 11/1989 (JP) .
4-116133 4/1992 (JP) .
6-220566 8/1994 (JP) .

OTHER PUBLICATIONS

Phys. Met. Metallogr., vol. 78, No. 1, '994, V.V. Manako et al., "Microstructure and Mechanical Properties of Internally Oxidized Mo–Re–Based Alloys", pp. 105–111.
Study and Use of Rhenium Alloys, 1978, E.M. Savitskii et al., "Effect of Alloying on the Properties of MR47–VP Alloy", pp. 175–182.
J. Phys. Condens. Matter, vol. 6, No. 27, Jul. 4, 1994, UK, S. Inoue et al., "Alloying Effect on the Electronic Structures of Nb and Mo", pp. 5081–5096.

*Primary Examiner*—John Sheehan
(74) *Attorney, Agent, or Firm*—Sughrue, Mion, Zinn, Macpeak & Seas, PLLC

(57) ABSTRACT

A super heat-resisting molybdenum-based alloy is disclosed. The alloy includes two or more alloying elements, the type and amount of the alloying elements being determined such that their average d-orbital energy level (average Md) and average bond order (average Bo) satisfy the following formula (3) and such that Tm is in the range of 2250–2700° C. in the following formula (4), the average Md and Bo being calculated by the formulas (1) and (2), and the bond order (Bo) with molybdenum and a d-orbital energy level being determined by the DV–Xα cluster method:

$$\text{Average } Bo = \Sigma Bo_i \times C_1 \quad (1)$$

$$\text{Average } Md = \Sigma Md_i \times C_i \quad (2)$$

$$1.718 \leqq \text{average } Md \leqq 1.881 \quad (3)$$

$$Tm(°C.) = (\text{average } Bo - 0.165 \times \text{average } Md - 4.899)/9.279 \times 10^{-5} \quad (4)$$

wherein, $Bo_i$ is a bond order of element "i", $Md_i$ is a d-orbital energy level of element "i", and $C_1$ is an atomic percent of element "i".

6 Claims, 6 Drawing Sheets

| | AVERAGE Bo | AVERAGE Md |
|---|---|---|
| A | 5.459 | 1.881 |
| B | 5.433 | 1.718 |
| C | 5.391 | 1.718 |
| D | 5.418 | 1.881 |
| E | 5.452 | 1.881 |
| F | 5.452 | 1.718 |
| G | 5.405 | 1.718 |
| H | 5.432 | 1.881 |

SUPER HEAT-RESISTING MO-BASED ALLOY AND METHOD OF PRODUCING SAME

This is a continuation of application Ser. No. 08/736,590 filed Oct. 24, 1996, now abandoned the disclosure of which is incorporated herein by reference.

BACKGROUND OF THE INVENTION

The present invention relates to a Mo-based alloy and a method for its production, and more particularly to a super heat-resisting Mo-based alloy and a method for its production. These Mo-based alloys can be used as structural materials for handling high temperature liquid alkalis, structural materials for use in apparatuses for evaluating handling techniques of Na and Li, structural materials for Na or Li-cooled fast reactors, structural materials of portable reactors, electrode materials for use in solidifying nuclear fuel recycling wastes with glass, MOX sintered plates, structural materials for use in nuclear fuel reprocessing units, target materials of accelerators, and various other high temperature functional materials.

Ferrous alloys such as austenitic stainless steels and ferritic stainless steels have been used to fabricate fast reactors. However, there is a general tendency for the service temperature of liquid Na as a coolant to increase as performance and efficiency of the fast reactor increase. Furthermore, it is desirable to use liquid Li as a coolant for portable reactors which must be more efficient than other reactors. However, materials which can withstand such severe conditions have yet to be developed.

There is a desire for ultra high temperature materials such as electrodes for use in nuclear fuel recycling systems, and target materials of accelerators, which can achieve a longer service life as well as higher efficiency than ever in their performance. Due to recent remarkable developments in the energy and aerospace industries, the range of applications of high temperature materials is widening and the need therefor is increasing.

However, as mentioned above, there has been no material which can withstand such severe service conditions. There is a great need for the development of a new material for such needs.

Powder metallurgical methods have mainly been used to produce alloys for use in ultra high temperature materials. Powder metallurgical methods inevitably result in defects in its metallurgical phases of alloys, with adverse effects on various properties of the resulting alloy products. It is desirable, therefore, that structural materials be produced using a melting process.

SUMMARY OF THE INVENTION

An object of the present invention is to provide an alloy material and a method of producing it, the material exhibiting improved resistance to a high temperature liquid alkali metal as well as improved mechanical properties at high temperatures.

More specifically, an object of the present invention is to provide an alloy having the above-mentioned properties and a method of producing the alloy, the alloy being produced by a melting process and not by a conventional powder metallurgical process.

An example of a material which can withstand such severe conditions is molybdenum, which is a refractory metal. Molybdenum has a melting point of 2623° C. and is expected to have a sufficient level of mechanical properties. Molybdenum, however, has problems with respect to its workability at room temperature. Namely, ductile-brittle transition temperature is usually higher than room temperature and a brittle intergranular fracture occurs at room temperature.

The corrosion resistance of molybdenum in liquid alkali metals, however, has not been investigated thoroughly. On the other hand, there is a great need for a molybdenum-based alloy with improved corrosion resistance in liquid alkali metals.

The inventors investigated heat resistance at 1200° C. as well as workability of a molybdenum-based alloy with an intention to provide a molybdenum-based alloy exhibiting improved heat resistance, i.e., high temperature creep strength, improved workability at room temperature, and improved corrosion resistance in high temperature liquid alkali metals.

Thus, the present invention is a method of producing a molybdenum-based alloy having a body-centered cubic, which comprises the steps of determining a bond order with molybdenum (Bo) as well as d-orbital energy level (Md) for two or more alloying elements by the DV–Xα cluster method, calculating a bond order and d-orbital energy level on average for an alloy composition based on the following formulas (1) and (2) to provide an average bond as well as an average d-orbital energy level and to determine the type and amount of the elements:

$$\text{Average } Bo = \Sigma Bo_i \times C_i \quad (1)$$

$$\text{Average } Md = \Sigma Md_i \times C_i \quad (2)$$

wherein, $Bo_i$ is the bond order of element "i", $Md_i$ is the d-orbital energy level of element "i", and $C_i$ is the atomic percent of element "i".

In another aspect, the present invention is a super heat-resisting molybdenum-based alloy which includes two or more alloying elements, the type and amount of which are determined such that their average d-orbital energy level (average Md) and average bond order (average Bo) satisfy the following formula (3) and such that Tm is in the range of 2250–2700° C. in the following formula (4), the average Md and Bo are calculated by the before-mentioned formulas (1) and (2), and the bond order (Bo) with molybdenum and the d-orbital energy 25 level are determined by the DV–Xα cluster method.

$$1.718 \leqq \text{average } Md \leqq 1.881 \quad (3)$$

$$Tm(^\circ\text{C.}) = (\text{average } Bo - 0.165 \times \text{average } Md - 4.899)/9.279 \times 10^{-5} \quad (4)$$

According to a preferred embodiment of the present invention, a super heat-resisting molybdenum-based alloy is prepared by a melting process and consists essentially of 2–40 at % of Re, 0.01–1.0 at % of Zr, and a balance of Mo and incidental impurities. The alloying elements satisfy the above-mentioned formulas (3) and (4).

In the preferred embodiment above, the alloy may further contain Hf in an amount of 10 at % or less.

DESCRIPTION OF THE PREFERRED EMBODIMENTS

According to the present invention, the DV–Xα cluster method, which is a molecular orbital calculation method, is employed to calculate some alloy parameters of various alloying elements to be added to a molybdenum-based alloy having a body-centered cubic (hereunder referred to merely as a "BCC"). After evaluating features of each of the alloying elements on the basis of the calculated alloy parameters, desirable alloying elements as well as their content are determined to design a new molybdenum-based alloy having desirable properties. In addition, using such alloy parameters, an existing molybdenum-based alloy can be evaluated from a theoretical viewpoint, and observations which are obtained during such evaluation will be helpful in developing a new type of molybdenum-based alloy.

In this specification, the desirable "properties" include heat resistance and workability, and the present invention is described based on a case in which an alloy is designed so as to achieve improvements in heat resistance and workability.

Principles of the present invention will next be described in detail.

Figure 1:
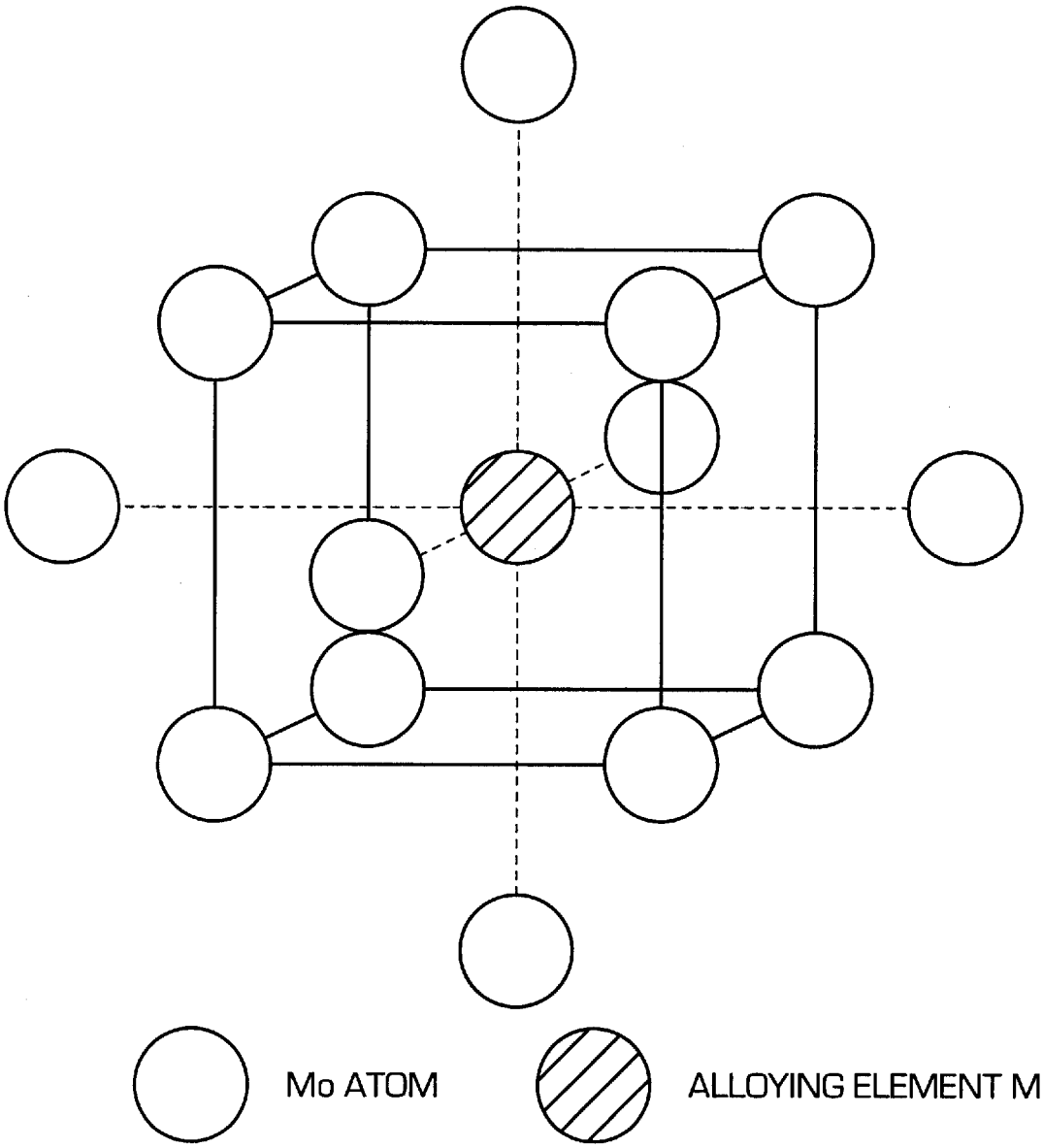
FIG. 1 is an illustration of a cluster model which is employed in calculating an electronic structure of a molybdenum-based, body-centered cubic alloy in accordance with the present invention.

(I) Determination of Alloy Parameters of Mo-Alloy Using a Molecular Orbital Calculation FIG. 1 is an illustration of a cluster model which is employed in calculating the electronic structure of a BCC Mo alloy. In this model, one alloying element M is positioned at the center of model and is surrounded by 14 Mo atoms at the first and second nearest neighbors. The interatomic distance for each of the atoms within the cluster is determined on the basis of the grating constant of elemental Mo of 0.31469 nm. Using this model, an electronic structure was calculated for each model in which the centered atom is replaced by various alloying elements M. Calculation was carried out using the DV (Discrete-Variational)–Xα cluster method, which is a calculation method of molecular orbitals. This method of calculation is described in detail in "Introduction to Quantum Material Chemistry" by H. Adachi published by Sannkyo Publishing Co.

Table 1 shows the values of the two alloy parameters Bo and Md for each of various alloying elements, the values being obtained by the calculation method above.

The alloy parameter Bo is a bond order, which indicates the degree of overlap of electron clouds in the interatomic distance between Mo and element X. The larger the value of Bo, the stronger the bond between the atoms.

The alloy parameter Md is a d-orbital energy level of alloying element M. A molecular orbital is constituted of the atomic orbitals of atoms which construct a cluster. Several molecular orbitals of alloying element M, which mainly come from the d-orbital, appear near the Fermi level. This alloying parameter Md is a weighted average of the energy for a molecular orbital which is constituted of the d-orbital of alloying element M. For further details refer to J. Phys.; Condens. Matter. 6(1994)5081–5096.

The parameter Md is related with electronegativity and atomic radius. The units of this Md are electron volts (eV), but the units will be omitted hereinafter for clarity.

It is to be noted that the values of Bo and Md for an alloying element shown in Table 1 are the same as those for Mo.

According to the present invention, therefore, the bond order and the d-orbital energy level are calculated for each alloying element, and the average Bo and Md for an alloy composition are calculated using the before-mentioned formulas (1) and (2). In this example, the average Bo and average Md for an alloy composition are calculated to three decimal places.

(II) Design and Production of Mo-Based Alloys Using the Alloy Parameters

An Mo-based alloy is known to have a high melting point and exhibits improved mechanical properties including high temperature creep strength. On the other hand, an Mo-based alloy which is prepared by a melting process, and not by a powder metallurgical process, is hard to work at room temperature. The average Md is a parameter on the basis of which workability can be determined. Thus, according to the present invention, a suitable range of average Md is determined in respect to workability based on experimental data from a three-point-bending test.

Figure 2:
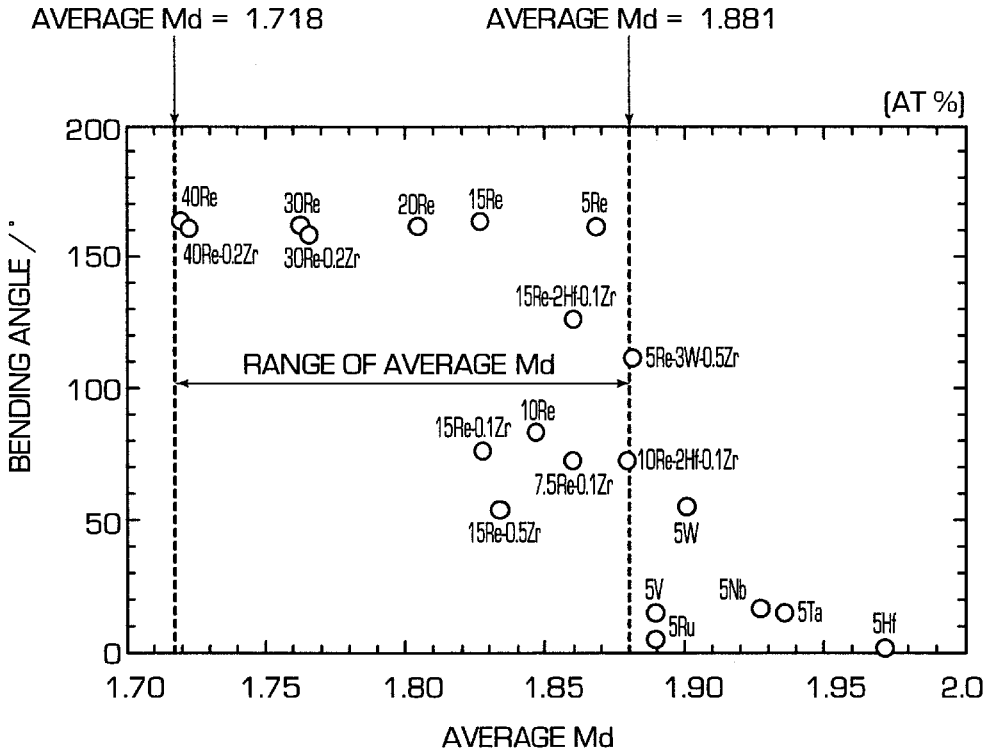
FIG. 2 is a graph showing a relationship between bending angles and average Md of an alloy.

FIG. 2 shows the relationship between a bending angle obtained by the bending test and average Md. It is noted from this graph that an Mo-based, binary or higher alloy which contains Re and has an average Md of in the range of 1.718 to 1.881 can exhibit improved workability. It is also to be noted that the value of average Md is approximately proportional to the content of Re (rhenium). It can be said that so long as the average Md is within this range determined by formula (3), the resulting Mo-based alloy can exhibit improved workability.

Figure 3:
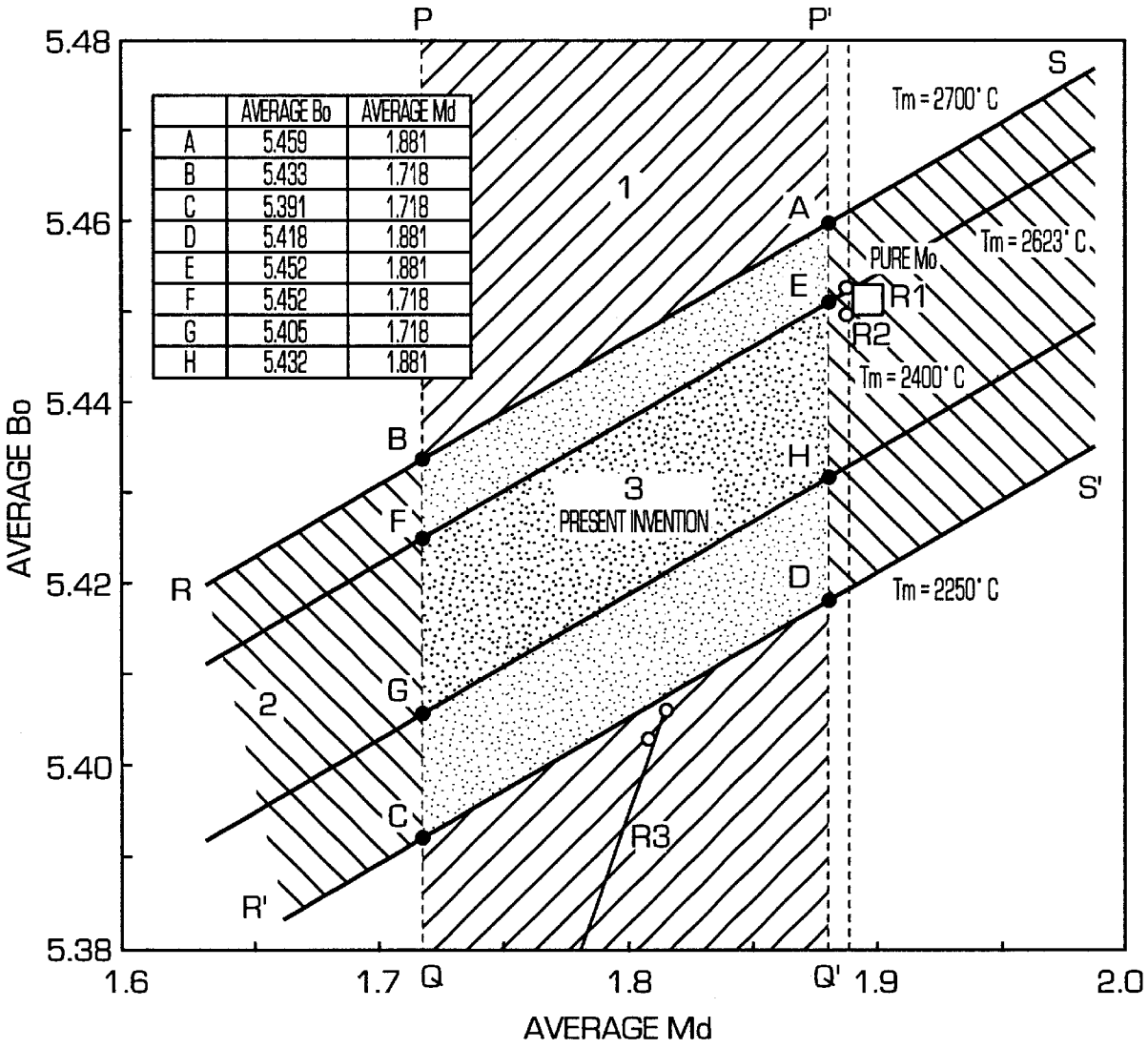
FIG. 3 is a diagram of an alloy composition of the present invention with respect to average Bo and average Md.

FIG. 3 shows the relation between Bo and Md. The area ①+ area ② lying between the straight lines PQ and P'Q' indicates the range defined by the formula (3) above.

Figure 4:
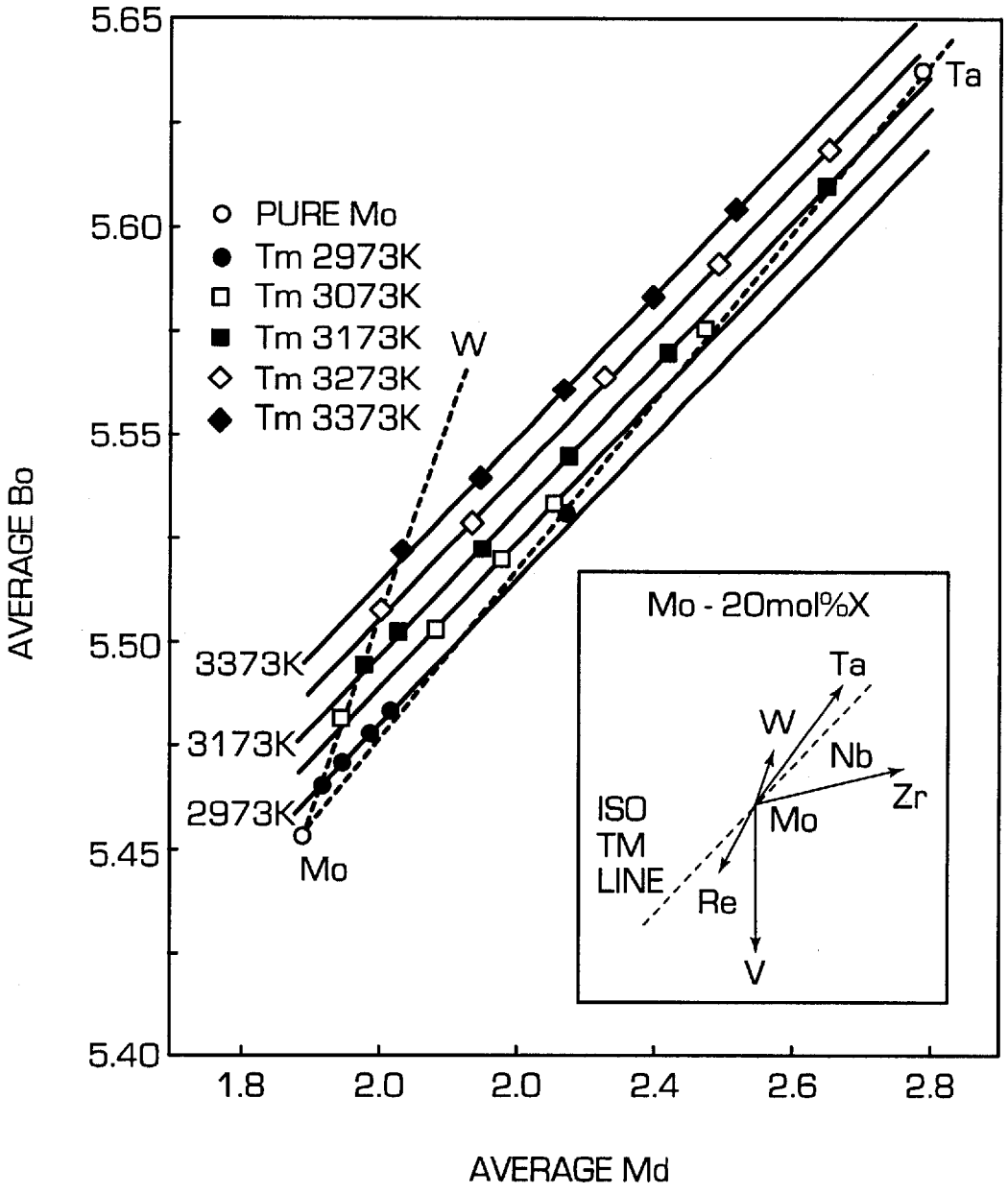
FIG. 4 is a graph showing the relationship of the melting point of a molybdenum-based alloy to average Bo and average Md.

It is known that there is generally a relation between the creep rupture strength of a heat-resisting alloy at high temperatures and the melting point thereof and that the higher the melting point, the longer the creep rupture time. Based on this relationship, high temperature properties can be estimated using the melting point as an alloy parameter, which has an influence on high temperature properties of this alloy. First, melting points of various alloying elements are plotted with respect to average Bo and average Md to give FIG. 4. Based on the results shown in FIG. 4, the before-mentioned formula (4) is obtained. Using this formula, it is possible to estimate a melting point of an alloy which is defined by average Md and average Bo.

The maximum service temperature of an Mo-based alloy of the present invention is 1200° C. Provided that the service temperature corresponds to the recrystallization temperature which is given by the formula (0.50–0.60Tm), the melting point of the alloy can be set at from 2250–2700° C. Therefore, according to the present invention, an alloy having a melting point of 2250–2700° C. is designed. The melting points referred to in this specification are calculated using the before-mentioned formulas (1), (2), and (4).

The resulting ranges for average Md and average Bo are indicated by the area ②+③ lying between straight lines RS and R'S' on the graph of FIG. 3.

Thus, an Mo-based alloy of the present invention which exhibits improvements in workability and creep rupture time is shown by an overlapped area between area ①+③ and area ②+③, i.e., a square area ③ defined by the points A, B, C and D on the graph of FIG. 3. The alloy of the present invention indicated on the graph of FIG. 3 covers ternary or multi-component alloys.

Commercial alloys having alloy compositions similar to that of the present invention are plotted on the graph of FIG. 3 as R1 (Japanese Patent No. 1,286,096), R2 (Patent Laid-Open Specification No. 220566/1994) and R3 (Patent Laid-Open Specification No. 116133/1992).

A preferred alloy composition of the present invention is indicated by a small square defined by the points E, F, G, and H on the graph of FIG. 3. The values of average Bo and average Md for each of these points are shown in the graph. Such a preferred alloy composition is designed by reducing the upper melting point from 2700° C. to 2623° C., and by restricting the lower melting point to 2400° C.

(III) Alloy Composition

More specifically, the alloy composition of a super heat-resisting Mo-based alloy of the present invention consists essentially of 2–40 at % of Re, preferably 5–25 at % of Re, 0.01–1.0 at % of Zr, preferably 0.05–0.30 at % of Zr, and a balance of Mo and incidental impurities.

A preferred alloy composition of the present invention with improved corrosion resistance consists essentially of 2–15 40 at % of Re, preferably 5–25 at % of Re, 0.01–1.0 at % of Zr, preferably 0.05–0.30 at % of Zr, up to 10 at % of Hf, preferably 0.1–5 at % of Hf, and a balance of Mo and incidental impurities.

The reasons why the alloy composition of the present invention is defined on the above manner will next be described.

Pure molybdenum is a high melting point metal exhibiting high strength at high temperatures. A molybdenum-based alloy, therefore, is expected to have high strength at high temperatures. However, molybdenum alloys obtained by a melting process do not exhibit a satisfactory level of workability at room temperature. In this respect, it is known that the addition of Re to pure Mo lowers the ductile-brittle transition temperature (DBTT) with improvement in workability. Thus, according to the present invention, 2–40 at % and preferably 5–25 at % of Re is added in order to improve workability at room temperature.

A corrosion test was carried out using liquid lithium at 1200° C. It was learned that pure Mo exhibited improved corrosion resistance against liquid lithium compared with other metals. Test results are shown in Table 2.

According to the present invention, therefore, in order that such superior properties can be maintained, a very small amount of Zr is added to the alloy to scavenge impurities contained in Mo. The addition of a large amount of zirconium has an adverse effect on workability.

Figure 5:
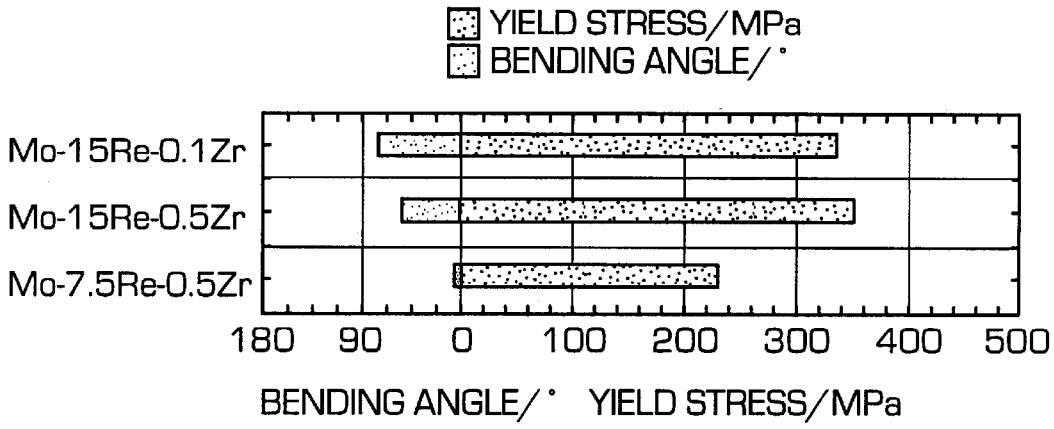
FIG. 5 is a graph showing test results of a three-point bending test for a molybdenum-based alloy of the present invention.

This is apparent from results of a three-point bending test, which are shown in FIG. 5. Namely, the bending angle for an alloy with a content of Zr of 0.5 at % is smaller than that for an alloy with a Zr content of 0.1%. Thus, the Zr content is defined as 0.01–1.0 at %, and preferably as 0.05–0.30 at % in order to improve workability.

Thus, according to the present invention, alloying elements Re and Zr are added to molybdenum to provide a molybdenum-based alloy which exhibits improved workability as well as strength, together with improved corrosion resistance against high temperature liquid lithium.

Figure 6:
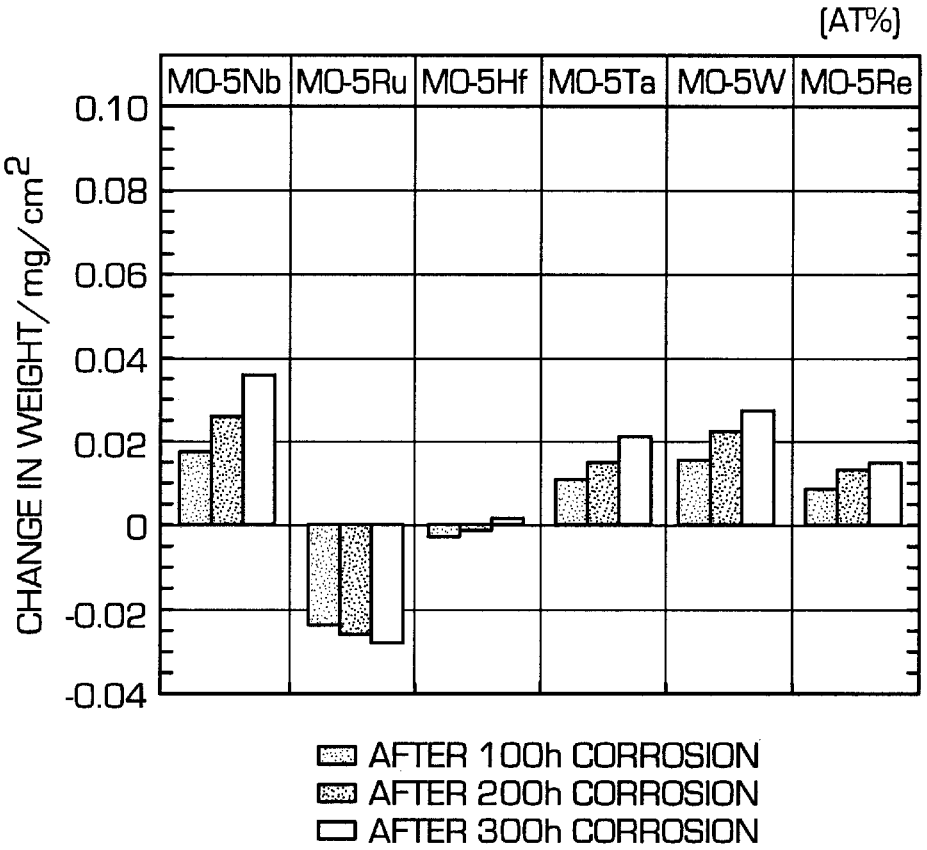
FIG. 6 is a graph showing a change in weight of a binary molybdenum-based alloy.

A corrosion test was carried out in a liquid lithium at 1200° C. for various binary Mo-based alloys. Test results are shown in FIG. 6. It is apparent from FIG. 6 that an alloy containing Hf exhibits the smallest weight change after the corrosion test, indicating that the addition of Hf markedly improves the corrosion resistance in liquid lithium.

Thus, according to the present invention, in a preferred embodiment, Hf is added as an alloying element in order to further improve the corrosion resistance in liquid lithium. The Hf content for this purpose is 10 at % or less, and preferably 0.1–5.0 at %.

In a preferred embodiment of the present invention, an Mo-based alloy with the addition of Re, Zr and Hf can be obtained, with improvements in high temperature strength, workability at room temperature, and corrosion resistance in liquid lithium.

Figure 7:
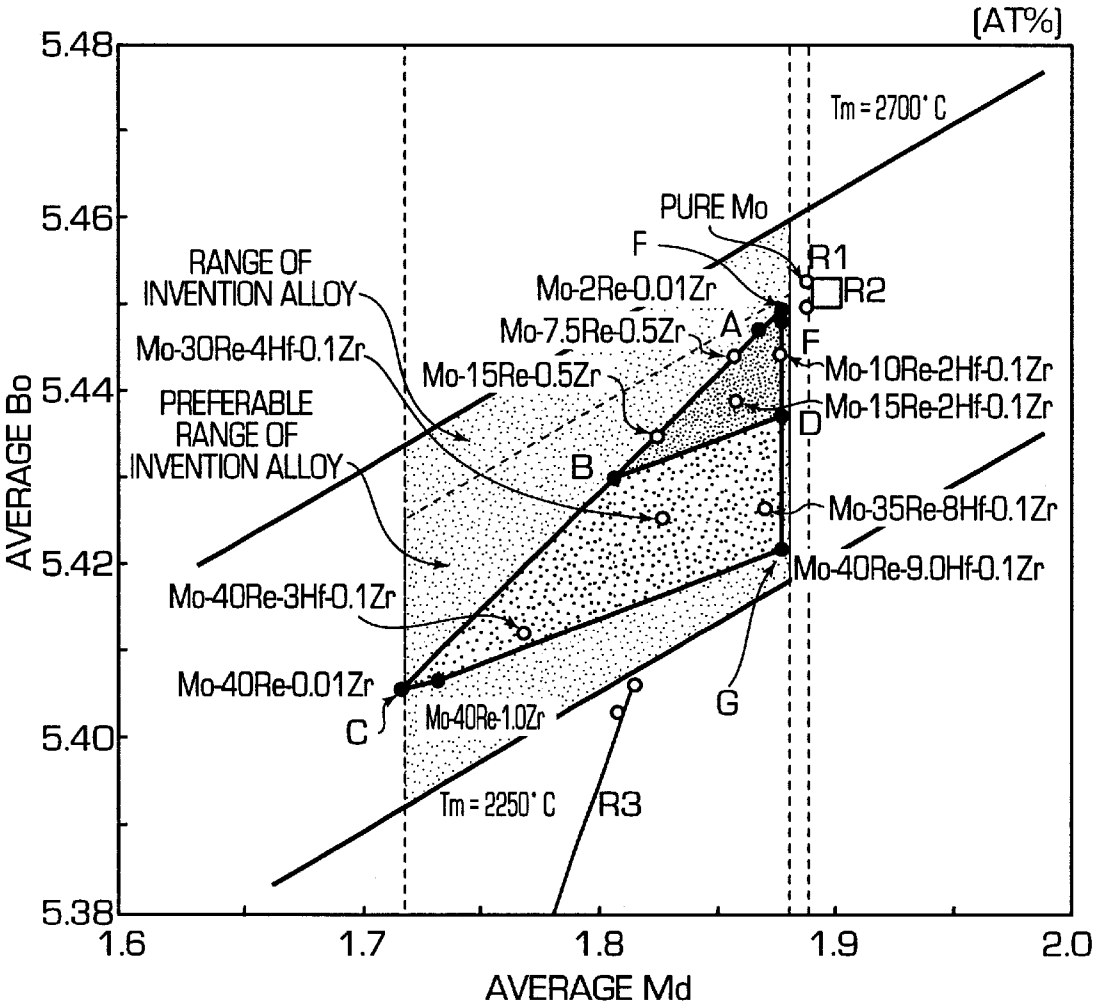
FIG. 7 is a diagram of an alloy composition of the present invention with respect to average Bo and average Md.

FIG. 7 shows various alloys of the present invention with respect to average Bo and average Md, in which alloys employed in the following examples are plotted for further reference.

The present invention will be described in further detail in conjunction with working examples, which are presented merely for illustrative purposes.

EXAMPLES

Seven types of Mo—Re—Zr(Hf) alloys which were designed in accordance with the present invention were prepared by a melting process. The melting point, bending angle in a three-point-bending test, and weight loss when dipped into liquid lithium at 1200° C. for 300 hours were determined for each of the alloys.

Test results are shown in Table 3. For comparative purposes, the properties of a commercial alloy TZM are also shown in Table 3. It is apparent from these results that an alloy of the present invention exhibits a melting point and workability which are substantially equal to those of the commercial alloy TZM, but it has a corrosion resistance in liquid lithium which is much superior to that of the commercial alloy TZM.

The alloy of the present invention can exhibit mechanical strength at high temperatures, and workability at room temperature, together with heat resistance and corrosion resistance at such a level that the alloy can be used as a structural material in liquid lithium at high temperatures. The alloy of the present invention, therefore, can be used not only in the nuclear power industry but also in the aerospace industry and other energy industries.

TABLE 1

| | | B o | M d |
|---|---|---|---|
| 3 d | Ti | 5.238 | 2.799 |
| | V | 5.212 | 1.893 |
| | Cr | 5.068 | 1.187 |
| | Mn | 4.849 | 0.781 |
| | Fe | 4.716 | 0.691 |
| | Co | 4.614 | 0.667 |
| | Ni | 4.459 | 0.265 |
| | Cu | 4.248 | −0.307 |
| 4 d | Y | 5.549 | 4.233 |
| | Zr | 5.511 | 3.457 |
| | Nb | 5.578 | 2.651 |
| | Mo | 5.453 | 1.890 |
| | Tc | 5.236 | 1.237 |
| 5 d | Hf | 5.630 | 3.523 |
| | Ta | 5.642 | 2.819 |
| | W | 5.554 | 2.113 |
| | Re | 5.337 | 1.462 |
| Others | Al | 5.096 | 1.890 |
| | Si | 5.034 | 1.890 |

TABLE 2

| Sample (at %) | Change in weight after 100 hours corrosion test ($mg/cm^2$) |
|---|---|
| Pure Zr | −10.212 |
| Pure Nb | +0.409 |
| Pure Mo | −0.141 |
| Pure Ta | —* |
| Pure W | −0.197 |
| Pure Re | +0.081 |

(Note)
*Specimen broken after corrosion test.

TABLE 3

| Invention Alloy (at %) | Average Bo | Average Md | M.P. (° C.) | Bending Angle (°) | Change in weight after 300 hours corrosion test ($mg/cm^2$) |
|---|---|---|---|---|---|
| Mo- 7.5Re-0.1Zr | 5.444 | 1.859 | 2600 | 72.2 | 0.030 |
| Mo- 15Re-0.5Zr | 5.435 | 1.827 | 2580 | 75.6 | 0.028 |
| Mo- 10Re-2Hf-0.1Zr | 5.445 | 1.881 | 2565 | 70.8 | 0.013 |
| Mo- 15Re-2Hf-0.1Zr | 5.439 | 1.860 | 2580 | 125.8 | 0.010 |
| Mo- 30Re-4Hf-0.1Zr | 5.425 | 1.828 | 2480 | 140.7 | 0.017 |
| Mo- 35Re-8Hf-0.1Zr | 5.426 | 1.872 | 2385 | 138.1 | 0.012 |
| Mo- 40Re-3Hf-0.1Zr | 5.412 | 1.769 | 2390 | 155.3 | 0.022 |
| TZM (Conventional Alloy) | 5.450 | 1.900 | 2620 | 136.4 | 0.057 |

What is claimed is:

1. A super heat-resisting molybdenum-based alloy consisting essentially of solid-solution strengthened molybdenum-based alloy having excellent resistance to corrosion by liquid lithium, which has been prepared by a melting process, and which includes two or more alloying elements including at least Re in an amount of 2–25 at %, the type and amount of the alloying elements being determined such that their average d-orbital energy level (average Md) and average bond order (average Bo) satisfy the following formulas (3) and (4), and such that Tm is in the range of 2250–2700° C. in the following formula (4), the average Md and Bo being calculated by the formulas (1) and (2), and the bond order (Bo) with molybdenum and a d-orbital energy level being determined by the DV–Xα cluster method:

$$\text{Average } Bo = \Sigma Bo_i \times C_i \quad (1)$$

$$\text{Average } Md = \Sigma Md_i \times C_i \quad (2)$$

$$1.718 \leqq \text{average } Md \leqq 1.881 \quad (3)$$

$$Tm(^\circ\text{C.}) = (\text{average } Bo - 0.165 \times \text{average } Md - 4.899)/9.279 \times 10^{-5} \quad (4)$$

wherein, $Bo_i$ is a bond order of element "i", $Md_i$ is a d-orbital energy level of element "i", and $C_i$ is an atomic fraction of element "i".

2. A super heat-resisting molybdenum-based alloy consisting essentially of solid-solution strengthened molybdenum-based alloy having excellent resistance to corrosion by liquid lithium, which has been prepared by a melting process, which consists essentially of 2–25 at % of Re, 0.01–1.0 at % of Zr, and a balance of Mo and incidental impurities.

3. A super heat-resisting molybdenum-based alloy as set forth in claim 2 wherein the content of Zr is 0.05–0.30 at %.

4. A super heat-resisting molybdenum-based alloy consisting essentially of solid-solution strengthened molybdenum-based alloy having excellent resistance to corrosion by liquid lithium, which is prepared by a melting process, which consists essentially of 2–25 at % of Re, 0.01–1.0 at % of Zr, 10 at % or less of Hf and a balance of Mo and incidental impurities.

5. A super heat-resisting molybdenum-based alloy as set forth in claim 4 wherein the content of Zr is 0.05–0.30 at %.

6. A super heat-resisting molybdenum-based alloy as set forth in claim 4 wherein the content of Hf is 0.1–5 at %.

* * * * *